United States Patent [19]

Raasch et al.

[11] Patent Number: 4,850,543

[45] Date of Patent: Jul. 25, 1989

[54] RECIPROCATING DEVICE FOR A LIFTER ROD OF AN OPEN-END SPINNING MACHINE

[75] Inventors: Hans Raasch; Reinhold Schmid; Hans-Willi Esser, all of Mönchengladbach, Fed. Rep. of Germany

[73] Assignee: W. Schlafhorst & Co., Mönchengladbach, Fed. Rep. of Germany

[21] Appl. No.: 135,826

[22] Filed: Dec. 21, 1987

[30] Foreign Application Priority Data

Dec. 20, 1986 [DE] Fed. Rep. of Germany ..... 3643783

[51] Int. Cl.[4] ..... B65H 54/02

[52] U.S. Cl. ..... 242/18 R; 242/18 DD; 242/43 R; 242/45

[58] Field of Search ..... 242/18 R, 18 DD, 43 R, 242/45, 35.5 R

[56] References Cited

U.S. PATENT DOCUMENTS

| | | | |
|---|---|---|---|
| 2,524,623 | 10/1950 | Colombu | 242/43 R X |
| 2,618,441 | 11/1952 | Marcellus | 242/45 |
| 2,950,068 | 8/1960 | Rutgers | 242/43 R |
| 3,359,715 | 12/1967 | MacKie | 242/43 R X |
| 3,640,477 | 2/1972 | Furst | 242/18 R |
| 4,002,306 | 1/1977 | Raasch | 242/18 R |
| 4,060,207 | 11/1977 | Miyazaki et al. | 242/18 R |
| 4,113,193 | 9/1978 | Raasch et al. | 242/18 R |
| 4,149,678 | 4/1979 | Miyazaki et al. | 242/18 R X |

FOREIGN PATENT DOCUMENTS

| | | |
|---|---|---|
| 2454917 | 11/1981 | Fed. Rep. of Germany . |
| 3432564 | 4/1985 | Fed. Rep. of Germany . |

*Primary Examiner*—Stanley N. Gilreath

*Attorney, Agent, or Firm*—Herbert L. Lerner; Laurence A. Greenberg

[57] ABSTRACT

A lifter rod actuates controllable yarn reserve devices of an open-end spinning machine. A reciprocating device for the lifter includes a shaft supported in the frame of the spinning machine and driven at a given angular velocity. A swash plate disposed on the shaft revolves at the given angular velocity. The swash plate has a circular-annular bearing with an outer ring being rotatable relative to the swash plate. The outer ring has an articulated coupling for mechanically jigging the lifter rod. A mechanical operative connection connects the articulated coupling with the lifter rod. The shaft, the swash plate, the bearing, the outer ring, the articulated coupling, the mechanical operative connection and the lifter rod form a mechanical operative chain. A jigging amplitude control device is diposed in the mechanical operative chain and firmly connected to and supported in the machine frame.

12 Claims, 3 Drawing Sheets

RECIPROCATING DEVICE FOR A LIFTER ROD OF AN OPEN-END SPINNING MACHINE

The invention relates to a reciprocating device for a lifter rod which actuates controllable yarn reserve devices of an open-end spinning machine.

In order to drive the lifter rod, the prior art provides a control drum with a guide curve, which is sensed by a two-armed lever that reports the movement thereof to the lifter rod. The lifter rod transmits the reciprocating or jigging motion thereof to the pivotable reserve or storage levers of the controlled yarn reserve or storage devices provided at the individual spinning stations. The law of motion to be obeyed for the motion of the yarn reserve, corresponds to a sinoid.

The control curve and sensing devices are vulnerable to wear, and the jigging amplitude is effected by deflecting the lifter rod out of its jigging direction, which is unfavorable for the transmission of force and for the transmission of the law of motion.

It is accordingly an object of the invention to provide a reciprocating device for a lifter rod of an open-end spinning machine, which overcomes the hereinaforementioned disadvantages of the heretofore-known devices of this general type and which provides a compact, reliably functioning, accurate and low-wear reciprocating device.

With the foregoing and other objects in view there is provided, in accordance with the invention, a reciprocating device for a lifter rod which actuates controllable yarn reserve devices of an open-end spinning machine, comprising a shaft supported in the frame of the spinning machine and driven at a given, preferably uniform, angular velocity: a swash plate being disposed on the shaft and revolving at the given angular velocity: the swash plate having a circular-annular bearing with an outer ring being rotatable relative to the swash plate; the outer ring having an articulated coupling for mechanically jigging the lifter rod: a mechanical operative connection connecting the articulated coupling with the lifter rod; the shaft, the swash plate, the bearing, the outer ring, the articulated coupling, the mechanical operative connection and the lifter rod forming a mechanical operative chain; a jigging amplitude control device disposed in the mechanical operative chain and firmly connected to and supported in the frame, and preferably means for infinitely adjusting the jigging amplitude control device during operation and/or stoppage of the reciprocating device In accordance with another feature of the invention, the mechanical operative connection is formed of a bridge extending transverse to the shaft and transverse to the lifter rod, the jigging amplitude control device is in the form of a sliding block displaceable in longitudinal direction of the bridge and pivotable transverse to the bridge, the sliding block having a pivot axis being movable from place to place and adjustable so as to be three-dimensionally fixed.

In accordance with a further feature of the invention, the sliding block has a pivot joint, and there is provided a pivot axis control device connected to the pivot joint.

In accordance with an added feature of the invention, the swash plate is pivotably supported on the shaft, and the jigging amplitude control device has a retaining device and a tilting device for the swash plate.

In accordance with an additional feature of the invention, there is provided a ball on which the swash plate is supported, the ball having a through bore formed therein and being displaceable on the shaft, and the retaining device being formed of a fixed link connected to the shaft and a coupling element disposed between the fixed link and the swash plate.

In accordance with yet another feature of the invention, the tilting device is formed of a variable-length support device being offset from the retaining device by 180° and being disposed between the swash plate and the fixed link.

In accordance with yet a further feature of the invention, there is provided a control element displaceable along the fixed link with a radial component, the swash plate having an extension arm, and the support device having a strap with two ends, one of the ends of the strap being pivotably supported on the extension arm of the swash plate and the other end of the ends being pivotably supported on the control element.

In accordance with another feature of the invention, the tilting device has a displaceable push rod guided along the shaft, connected to the ball, and fixable with respect to the shaft, the shaft has a central bore formed therein for receiving the push rod and the shaft has first and second longitudinal slits longitudinally spaced apart from one another therein, and there is provided a control device, a first bolt connecting the push rod to the ball through the first longitudinal slit and a second bolt connecting the push rod to the control device through the second longitudinal slit.

In accordance with a concomitant feature of the invention, the control device has an inner ring being displaceable on the shaft, an outer ring, an indexing lever, an indexing bolt cooperating with the indexing lever or with a slot formed in the indexing lever, and at least one roller bearing connecting the inner ring with the outer ring.

Other features which are considered as characteristic for the invention are set forth in the appended claims.

Although the invention is illustrated and described herein as embodied in a reciprocating device for a lifter rod of an open-end spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
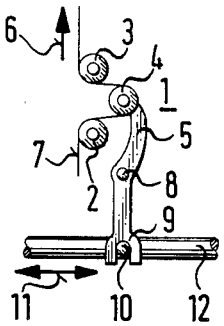
FIG. 1 is a fragmentary, diagrammatic, elevational view of a yarn reserve or storage device.

Referring now to the figures of the drawings in detail and first, particularly, to FIG. 1 thereof, there is seen a yarn reserve or storage device 1 of an open-end spinning machine. Yarn reserve devices of this type are needed, for instance, in winding conical cheeses or cross-wound bobbins, so that an uneven yarn-receiving capacity of the conical cheese can be compensated for, while maintaining uniform yarn feed.

The yarn reserve device 1 shown in FIG. 1 has two rollers 2, 3 supported on a machine frame and one roller 4 supported on a pivotable reserve or storage lever 5. The roller 2 may be the unwinding or take-off shaft or the unwinding or take-off roller of the spinning station.

Yarn or thread 7 travelling in-the direction of an arrow 6 first wraps around the roller 2, then the roller 4, and finally the roller 3.

The reserve or storage lever 5 is pivotably supported about a pivot axis 8 on the machine frame. The lever 5 has two arms and is provided with a fork 9 at the lower end thereof. A sliding block 10 of a lifter rod 12 that jigs, traverses or reciprocates in the direction of a double arrow 11, passes through the fork 9, so that the reserve lever 5 pivots back and forth along with the roller 4 upon jigging of the lifter rod 12. As a result, a yarn loop of continuously changing size forms in the yarn reserve device 1 while at the same time the yarn running up onto the conical cheese jigs from the neutral diameter of the cone, toward the small end of the cone, back to the neutral diameter, to the large end of the cone, and back again to the neutral diameter.

The lifter rod 12 actuates the yarn reserve devices 1 of one entire side of the machine. It is therefore important that the lifter rod 12 have a sturdy, durable, well-functioning and easily adjustable reciprocating cross-winding device assigned thereto. A first embodiment of a reciprocating device 13 is shown in a longitudinal section in FIG. 2.

A shaft 14 driven at uniform angular velocity is supported in walls 15 of a closed housing by means of a roller bearing 16. The left end of the shaft 14 is provided with a central bore 17. The central bore 17 serves to receive a push rod 18. The push rod 18 has a first bolt 19 and a second bolt 20. Opposite the bolts, the remaining tubular wall 23 of the shaft 14 is provided with a first longitudinal slit 21 and a second longitudinal slit 22. The bolt 19 is connected through the first slit 21 with a bored-open ball 24 that is longitudinally displaceable on the shaft 14. The second bolt 20 is connected through the second longitudinal slit 22 with a ring 25 that is longitudinally displaceable on the shaft 14 and is part of a control device 26. A swash or tumbling plate formed of swash or tumbling plate halves 27 and 28, is supported on the ball 24. The swash plate 27, 28 has a circular-annular roller bearing 29, which has an outer ring 30 that is capable of revolution relative to the swash plate 27, 28.

The outer ring 30 is connected to the lifter rod 12 by means of an articulated coupling 31. The coupling 31 is formed of the following elements:

The outer ring 30 has a radially extending pin 32, which is provided with a thread 33 on the end thereof. A bearing sleeve 34 is slipped onto the pin 32 and firmly connected to the outer ring 30 by a means of a nut 36 screwed onto the pin 32 along with a lock washer 35. The bearing sleeve 34 has a ball 37 that is bored all the way through and is slideably supported in a spherically-recessed ring 38. The ring 38 is inserted into a bearing eye 39 of a fork 40. The fork 40 articulatedly encompasses a connecting element 41. The joint is formed by a bolt 42.

Figure 2:
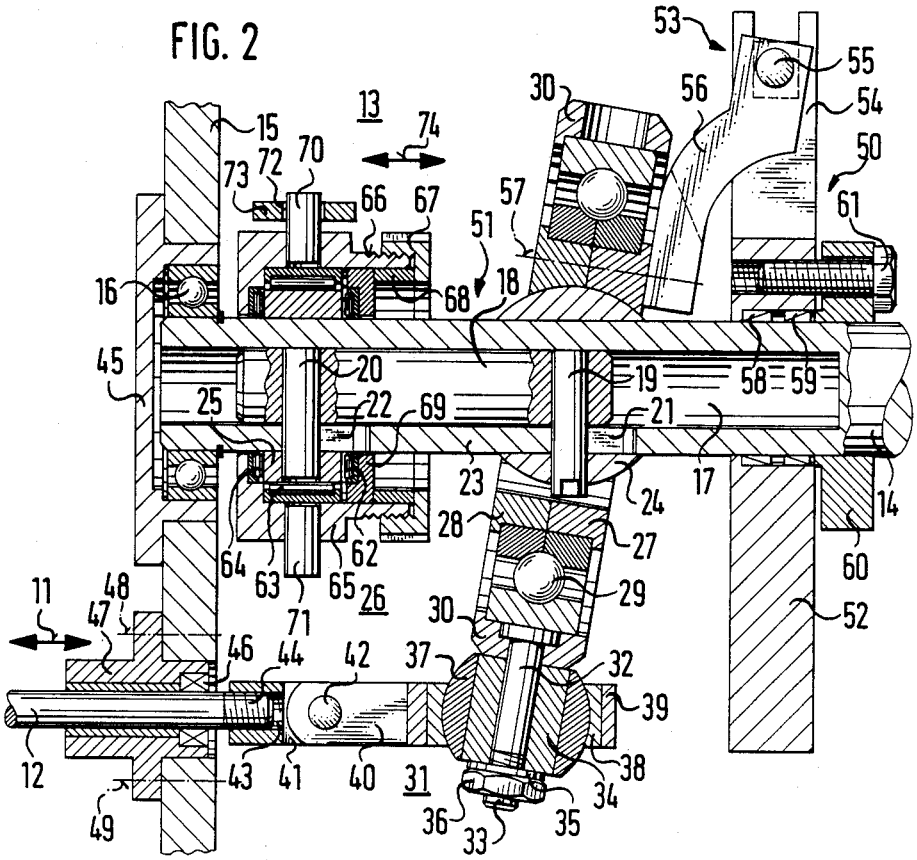
FIGS. 2, 3 and 4 are fragmentary, sectional views of various embodiments of reciprocating devices.

The lifter rod 12 provided with an external thread 44 and the connecting element 41, which is partially broken away in FIG. 2, has an internal thread 43 into which the end of the lifter rod 12 screwed.

While the roller bearing 16 of the shaft 14 is connected to the wall 15 with the aid of a bushing 45, a stuffing box 47 equipped with a sealing gland or rod packing 46 is provided for the passage of the lifter rod 12 out of the housing of the reciprocating device 13. The stuffing box is screwed to the wall 15, as indicated by center lines 48, 49.

The swash plate 27, 28 pivotably supported on the shaft 14 is provided with a reciprocating or jigging amplitude control device 26, which is divided in two and is formed of a retaining device 50 and a tilting device 51. The tilting device 51 includes elements 18-26 already mentioned and described above. The retaining device 50 includes a fixed link 52 connected to the shaft 14 and a coupling element 53 disposed between the fixed link 52 and swash plate 27, 28.

For the sake of balancing mass, the fixed link 52 is in the form of a disk, except for the point at which it forms a fork 54, which serves as a slot for a sliding block 55. The sliding block 55 together with the fork 54 forms a sliding block and slot configuration forming the coupling element 53. The sliding block 55 is inserted into a fork 56, which surrounds the first fork 54 and is screwed to the swash plate 27, 28 as indicated by a center line 57.

The fixed link 52 is firmly connected to the shaft 14 by means of clamping rings 58, 59, which are loaded by a configuration formed of a pressing ring 60 and screws 61.

The ring 25 mentioned above is connected to an outer ring 65 by roller bearings 62, 63, 64 and is part of the control device 26 which was also already mentioned. The outer ring 65 has a concentric external thread 66, onto which a union nut 67 is screwed. The union nut 67 loads pressing rings 68 and 69, which hold together the assembly formed of the ring 25, roller bearings 62, 63, 64 and outer ring 65. When the shaft 14 rotates, the outer ring can remain stationary relative to the shaft 14. The outer ring 65 is provided with indexing bolts 70 and 71. The indexing bolt 70 is supported in a slot 72 of a pivotable indexing lever 73, which is extended to the outside through the wall of the housing of the reciprocating device 13 in a non-illustrated manner. With the aid of the indexing lever 73, the control device 26 and with it the push rod 18 serving as a tilting device for the swash plate 27, 28 can be displaced parallel to the direction of a double arrow 74. After the displacement, locking in the tilted position is effected by fixation of the indexing lever 73, either by self-locking, by means of a detent or by being screwed to the housing of the reciprocating device 13.

While the shaft 14 rotates, the swash plate 27, 28 rotates along with it at the same angular velocity, but the outer ring 30 does not, since it is prevented from rotating by the coupling 31. The outer ring only executes a jigging motion dependent on the tumbling motion and this causes the jigging, reciprocation or traversing of the lifter rod 12 in the direction of the double arrow 11.

In the embodiment of FIG. 2, the push rod or tilting device 18 can be displaced so far to the right that any tumbling motion of the swash plate 27, 28 ceases. This is a particular advantage of the novel device, because in this case the yarn reserve devices can be put out of action in the event that cylindrical cheeses instead of conical cheeses are to be wound.

Figure 3:
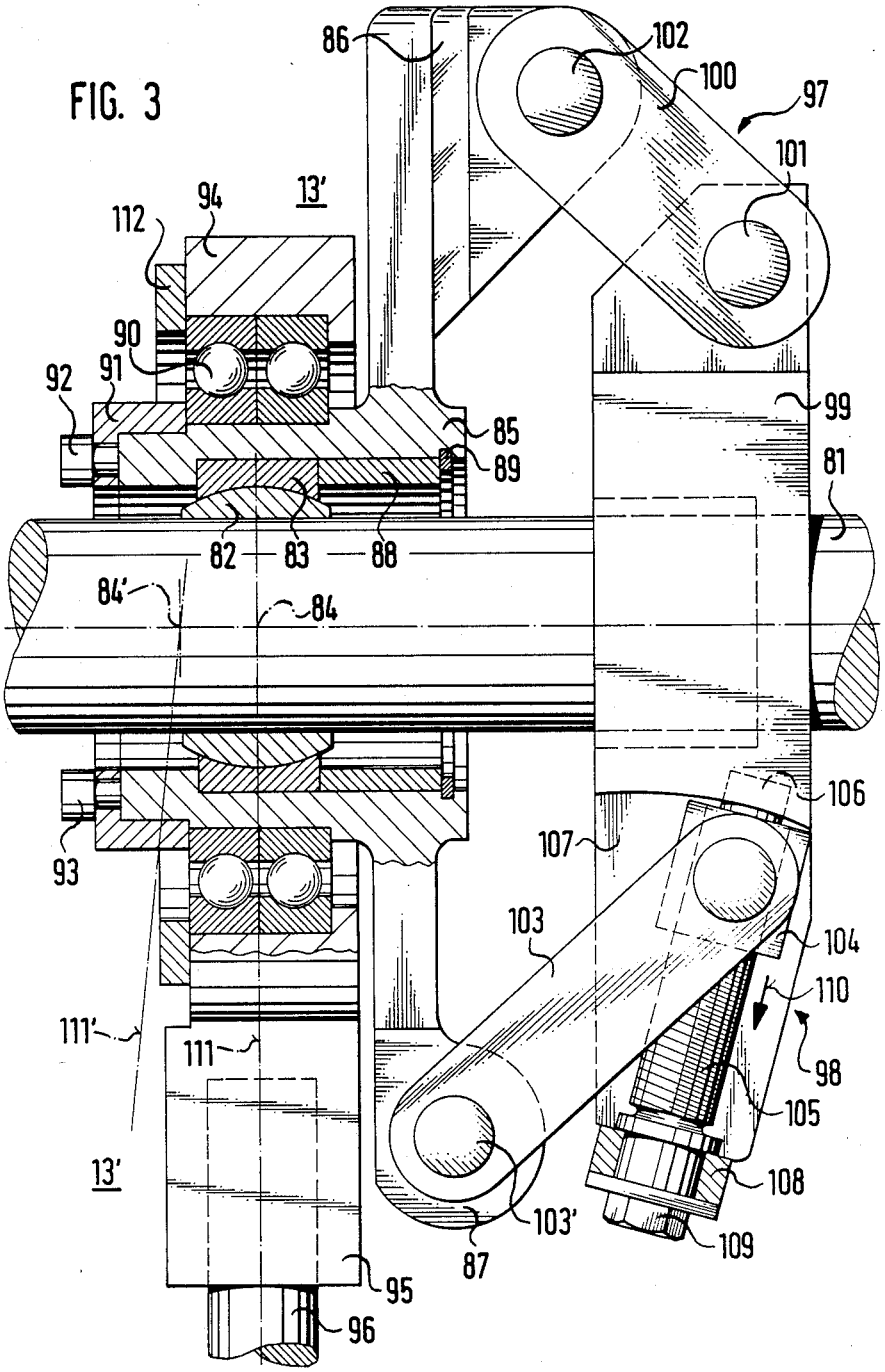

The embodiment of the invention according to FIG. 3 differs in principle from the embodiment of FIG, 2 because it has a different kind of jigging amplitude control device.

In the alternative reciprocating device 13' of FIG. 3, a shaft 81 rotating at uniform angular velocity has a centrally bored-open ball 82, which is displaceable on the shaft 81. A spherically constructed swash plate 83 is pivotably and slidingly supported on the ball 82 about a center point 84. The swash plate 83 has a ring 85, which has two extension arms 86, 87 opposite one another. The position of the ring 85 on the swash plate 83 is secured by a sleeve 88 in combination with a locking ring 89.

The ring 85 has a circular-annular roller bearing 90. The bearing 90 is a double ball bearing and is positionally secured by a cap 91. The cap 91 is screwed to the ring 85 with screws 92, 93. The roller bearing 90 has an outer ring 94. The outer ring 94 has an extension arm 95, which is provided with a bolt 96 that is part of a coupling which is not otherwise illustrated. The bolt can be compared with the pin 32 of the embodiment of FIG. 2.

In the embodiment of FIG. 3, the jigging amplitude control device is formed of a retaining device 97 and a tilting device 98 for the swash plate 83.

The retaining device 97 is formed of a fixed link 99 connected to the shaft 81 and a coupling element 100 disposed between the fixed link 99 and the swash plate 83. The coupling element 100 is formed of a strap pivotably supported on the fixed link 99 and on the extension arm 86 of the swash plate 83 by means of bolts 101, 102. For the sake of symmetry, a second strap can also be provided, which would be hidden by the strap 100 in FIG. 3. The fixed link 99 is firmly connected to the shaft 81 in a suitable manner.

The tilting device 98 is in the form of a variable-length supporting device which is offset from the retaining device 97 by 180° and is disposed between the swash plate 83 and the fixed link 99 connected to the shaft 81. The supporting device 98 has a strap 103, one end of which is pivotably supported by means of a bolt 103' on an extension arm 87 of the swash plate or the ring 85 and the other end of which is pivotably supported on a control element 104 that is displaceable with a radial component along the fixed link 99. The control element 104 is constructed as a spindle nut, which is engaged by a spindle 105 supported on the fixed link 99 in a rotatable and lockable manner. The back end of the spindle 105 is supported in a bore 106 that is located on the bottom of a recess 107 in the fixed link 99. The forward end of the spindle 105 is braced against a bored-open bridge 108 of the fixed link 99. A hexagonal head 109 serves to rotate and lock the spindle 105.

For the sake of symmetry, a second strap can be provided in addition to the strap 103. In such a case, the second strap would be hidden by the strap 103 in FIG. 3.

In the position of the swash or drum plate 83 shown in FIG. 3, no tumbling and thus no jigging takes place upon rotation of the shaft 81. However, by rotating the spindle 105, the control element 104 can be displaced in the direction of an arrow 110, which causes the center point 84 to move to the position 84', for instance, and the center axis 111 to move to the position 111'. In that case the respective location of the straps 100 and 103 varies as well. The location of the outer ring 94 can be secured by means of a washer 112.

While the embodiment of FIG. 2 has the advantage of permitting the locked position of the swash plate to be adjusted from outside the housing during operation, the embodiment of FIG. 3 has other advantages:

Its construction of the FIG. 3 device is simpler, the retaining device is sturdier and functions more accurately, the tilting device is simpler, and the shaft 81 does not need to be weakened by being bored open.

Figures 4, 5, 6:
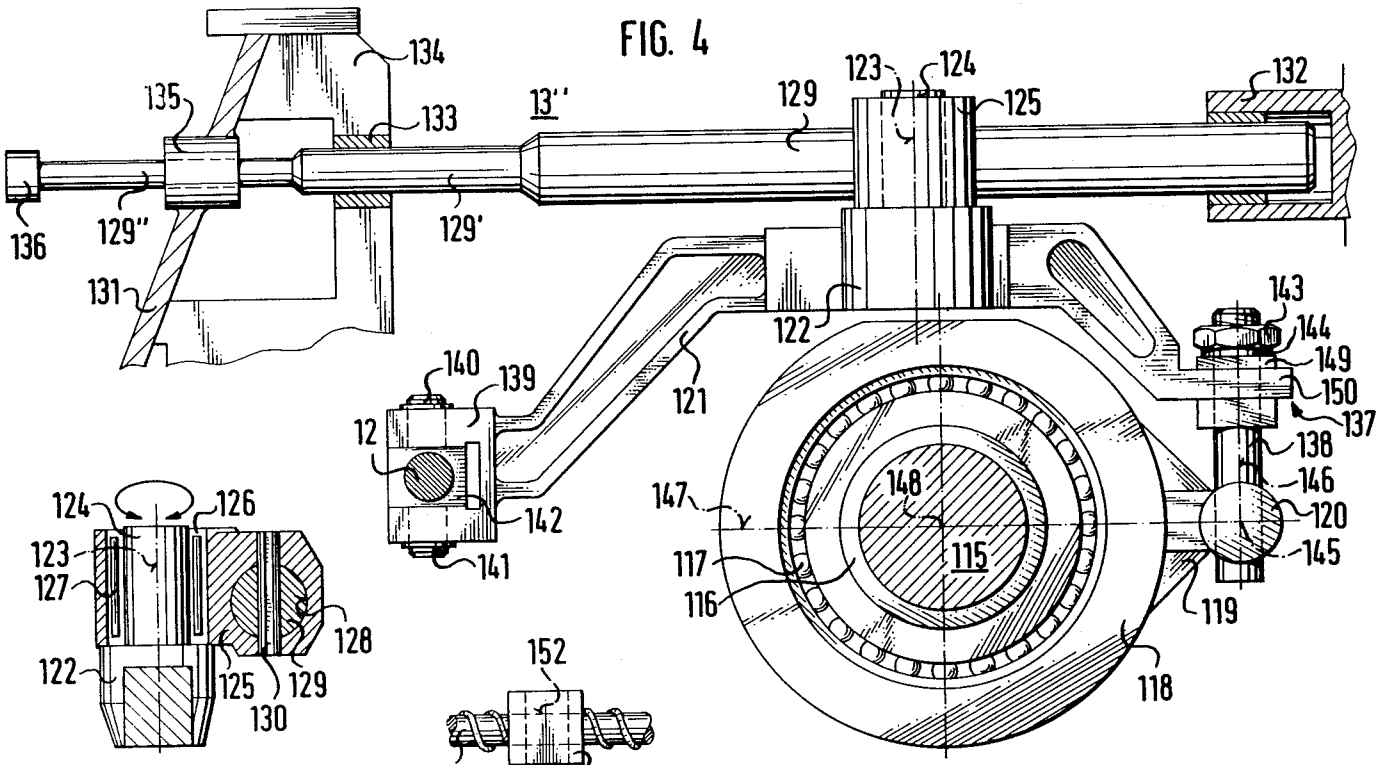
FIGS. 5 and 6 are respective sectional and fragmentary elevational views showing details of the reciprocating device of FIG. 4.

In the embodiment of FIG. 4, a swash plate 116 seated on a shaft 115 is firmly connected to the shaft 115 in a predetermined tilted position. The swash plate 116 has a roller bearing 117, which in turn is provided with an outer ring 118. An articulated coupling 120, which may be constructed as a ball-and-socket joint, is located on an extension arm 119 of the outer ring 118.

A mechanical operative connection of the articulated coupling 120 with the lifter rod 12 exists in the form of a bridge 121 extending transversely to the shaft 115 and transversely to the lifter rod 12. A sliding block that is displaceable along the bridge 121 is provided as a jigging amplitude control device 122. The sliding block 122 has a pivot axis 123 that can be moved from place to place and adjusted in such a way that it is three-dimensionally fixed. The sliding block 122 or jigging amplitude control device has a pivot joint, formed of an upright axle journal 124 connected to the sliding block 122 as shown in FIG. 5 and a bearing block 125. As seen in FIG. 5, the bearing block 125 has a bearing eye 126, which receives a needle bearing 127.

The axle journal 124 is inserted into the needle bearing 127. The bearing block 125 also has a bore 128 located transverse to the axial direction of the bearing eye 126, into which a push rod 129 serving as a pivot axis control device is inserted. The push rod 129 is firmly connected to the bearing block 125 by means of a clamping sleeve 130.

The entire reciprocating device identified by reference numeral 13'' is introduced into a closed housing, only one wall portion 131 of which is visible in FIG. 4.

The back end of the push rod 129 is displaceably supported in a slide bearing 132 in the interior of the housing. The push rod 129 is stepped down twice toward the forward end thereof in order to have a smaller diameter, as shown in FIG. 4. A step 129' is displaceably supported in a slide bearing 133. The slide bearing 133 is disposed in a console 134, which is connected to the wall portion 131. An oil-tight stuffing box 135 is inserted in the wall portion 131, and a step 129'' is guided to the outside through the stuffing box 135. An adjusting knob 136 is located on the end of the step 129''.

The pivot axis 123 of the control device 122, which at the same time is the pivot axis of the bridge 121, is displaced by displacing the push rod 129 by means of the adjusting knob 136.

The right-hand end of the bridge 121 forms a bearing eye 137 in which a bolt 138 of the coupling 120 is pivotably supported. The left-hand end of the bridge 121 has a fork 139 which receives two pivotably supported prongs 140, 141 of a clamping element 142, in which the end of the lifter rod 12 is firmly clamped.

As soon as the shaft 115 rotates, the swash plate 116 tumbles, while the outer ring 118 remains bound by the articulated coupling 120. The bolt 138 of the coupling is bound to the bearing eye 137 of the bridge 121 by a nut 143 and a plain washer 144. Since the bridge 121 itself is secured against tilting by the lifter rod 12 and the sliding block 122, it can only pivot about the upright pivot axis 123. Meanwhile an axis intersection 145 which is located at the intersection of a longitudinal axis 146 passing through the bolt 138 and a longitudinal axis 147 passing through the swash plate 116, pivots in a horizontal plane approximately about a center point 148. Since the center point 148 might be located outside the pivot axis 123, the bearing eye 137 is disposed in a cube 149, which has grooves on two opposed sides that receive the forked ends 150 of the bridge 121. A sliding equalization of length during the jigging can be means of this configuration depending upon the distance of the center of rotation 148 from the pivot axis 123.

Since the jigging stroke is on the order of a maximum of 30 mm, it is generally not necessary to make provisions for length compensation at the left-hand end of the bridge 121. It is especially unnecessary if the first bearing point of the lifter rod 12 is located relatively far from the clamping element 142. In any case, the lifter rod 12 can be connected through a joint to the clamping element 142.

In the alternative embodiment of FIG. 6, a pivot axis control device 151 includes a spindle which engages a thread 152 of an alternative bearing block 153, which is part of a pivot joint identified overall by reference numeral 154 in FIG. 6. The spindle 151 can be rotatably supported in the housing of the reciprocating device 13''. For adjustment purposes, a lengthened end of the spindle which is not provided with a thread, can be extended out of the housing. There it can be provided with a control device and optionally a position display device. A hand wheel with a pointer is sufficient for the control device and position display device.

We claim:

1. In an open-end spinning machine including a frame, controllable yarn reserve devices, and a lifter rod actuating the yarn reserve devices, a device for reciprocating the lifter rod, the reciprocating device comprising a shaft supported in the frame of the spinning machine and driven at a given angular velocity;

a swash plate being disposed on said shaft and revolving at said given angular velocity;

said swash plate having a circular-annular bearing with an outer ring being rotatable relative to said swash plate;

said outer ring having an articulated coupling for mechanically jigging said lifter rod;

a mechanical operative connection connecting said articulated coupling with the lifter rod;

said shaft, said swash plate, said bearing, said outer ring, said articulated coupling, said mechanical operative connection and the lifter rod forming a mechanical operative chain;

and a jigging amplitude control device disposed in said mechanical operative chain and firmly connected to an supported in the frame.

2. Reciprocating device according to claim 1, wherein said given angular velocity of said shaft is a uniform angular velocity.

3. Reciprocating device according to claim 1, including means for infinitely adjusting said jigging amplitude control device during operation and stoppage of the reciprocating device.

4. Reciprocating device according to claim 1, wherein said mechanical operative connection is formed of a bridge extending transverse to said shaft and transverse to the lifter rod, said jigging amplitude control device is in the form of a sliding block displaceable in longitudinal direction of said bridge and pivotable transverse to said bridge, said sliding block having a pivot axis being movable from place to place and adjustable so as to be three-dimensionally fixed.

5. Reciprocating device according to claim 4, wherein said sliding block has a pivot joint, and including a pivot axis control device connected to said pivot joint.

6. Reciprocating device according to claim 1, wherein said swash plate is pivotably supported on said shaft, and said jigging amplitude control device has a retaining device and a tilting device for said swash plate.

7. Reciprocating device according to claim 6, including a ball on which said swash plate is supported, said ball having a through bore formed therein and being displaceable on said shaft, and said retaining device being formed of a fixed link connected to said shaft and a coupling element disposed between said fixed link and said swash plate.

8. Reciprocating device according to claim 7, wherein said tilting device is formed of a variable-length support device being offset from said retaining device by 180° and being disposed between said swash plate and said fixed link.

9. Reciprocating device according to claim 8, including a control element displaceable along said fixed link with a radial component, said swash plate having an extension arm, and said support device having a strap with two ends, one of said ends of said strap being pivotably supported on said extension arm of said swash plate and the other end of said ends being pivotably supported on said control element.

10. Reciprocating device according to claim 7, wherein said tilting device has a displaceable push rod guided along said shaft, connected to said ball, and fixable with respect to said shaft, said shaft has a central bore formed therein for receiving said push rod and said shaft has first and second longitudinal slits longitudinally spaced apart from one another therein, and including a control device, a first bolt connecting said push rod to said ball through said first longitudinal slit and a second bolt connecting said push rod to said control device through said second longitudinal slit.

11. Reciprocating device according to claim 10, wherein said control device has an inner ring being displaceable on said shaft, an outer ring, an indexing lever, an indexing bolt cooperating with said indexing lever, and at least one roller bearing connecting said inner ring with said outer ring.

12. Reciprocating device according to claim 10, wherein said control device has an inner ring being displaceable on said shaft, an outer ring, an indexing lever, an indexing blot cooperating with a slot formed in said indexing lever, and at least one roller bearing connecting said inner ring with said outer ring.

* * * * *